US005694958A

United States Patent [19]

Chang

[11] Patent Number: 5,694,958

[45] Date of Patent: Dec. 9, 1997

[54] UMBRELLA RIB AND TIP ARRANGEMENT

[76] Inventor: John Chang, No. 10, Cheng Chang Erh St, Chung Li City, Taiwan

[21] Appl. No.: 739,207

[22] Filed: Oct. 29, 1996

[51] Int. Cl.[6] ..... A45B 25/00

[52] U.S. Cl. ..... 135/33.5; 135/33.41; 135/31

[58] Field of Search ..... 135/33.4, 33.41, 135/33.5, 31, 29, 15.1, 32, 33.2

[56] References Cited

U.S. PATENT DOCUMENTS

| | | | |
|---|---|---|---|
| 957,527 | 5/1910 | Wetteroth . | |
| 1,007,320 | 10/1911 | Wurster . | |
| 1,060,712 | 5/1913 | Schultz et al. . | |
| 2,185,587 | 1/1940 | Carlisle . | |
| 4,084,600 | 4/1978 | de Polo | 135/33.4 X |
| 5,226,438 | 7/1993 | Dubinsky | 135/33.4 |
| 5,305,771 | 4/1994 | Wilk | 135/31 |
| 5,394,896 | 3/1995 | Wilk | 135/31 |
| 5,529,083 | 6/1996 | Martin . | |

FOREIGN PATENT DOCUMENTS

| | | | |
|---|---|---|---|
| 0439889 | 1/1927 | Germany | 135/33.5 |
| 2095548 | 10/1982 | United Kingdom | 135/33.5 |

*Primary Examiner*—Lanna Mai

*Attorney, Agent, or Firm*—Morton J. Rosenberg; David I. Klein

[57] ABSTRACT

An umbrella rib and tip arrangement including an umbrella rib having a front end terminating in a plug rod, and a T-cap having an arched transverse head mounted in a pocket at the periphery of an umbrella cover and a circular longitudinal cap body perpendicularly extended from the arched transverse head and capped on the plug rod of the umbrella rib.

2 Claims, 9 Drawing Sheets

UMBRELLA RIB AND TIP ARRANGEMENT

BACKGROUND OF THE INVENTION

The present invention relates to umbrellas, and more specifically to umbrella rib and tip arrangement for umbrellas which keeps the periphery of the umbrella cover to be maintained in a smoothly curved configuration so that it does not hurt people.

The umbrella rib and tip arrangement of a regular umbrella, as shown in FIGS. 1 and 2, comprises a metal umbrella rib 2 adapted for stretching the umbrella cover 1, and having a front end terminating in a tip 21. The tip 21 has a hole 22 fastened to the border 11 of the umbrella cover 1 by stitches 12. Because the tip 21 a metal object projecting out of the border of the umbrella cover 1, it tends to hurt people when the umbrella is opened. More particularly, when this structure of umbrella rib is used in an automatic umbrella and the automatic umbrella is opened, the user may be injured by the tip of the umbrella rib. In order to eliminate this problem, a bead or like device (not shown) may be mounted on the tip 21 of the umbrella rib 2 for protection. However, because the bead is disposed outside the umbrella cover 1 and spaced from the border of the umbrella cover 1 at more than 1 cm, it will still hurt people when the umbrella is suddenly opened. Another drawback of this umbrella rib and tip arrangement is that the stitches 12 tend to be broken or loosened from the umbrella cover 1, thereby causing the tip 21 to be disconnected from the umbrella cover 1. Because the tip 21 of the umbrella rib 2 is fastened to the umbrella cover 1 by stitches 12, the installation procedure of the umbrella rib 2 is complicated and time-consuming.

SUMMARY OF THE INVENTION

It is one object of the present invention to provide an umbrella rib and tip arrangement which is safe in use. It is another object of the present invention to provide an umbrella rib and tip arrangement which is easy to install. It is still another object of the present invention to provide an umbrella rib and tip arrangement which does not disconnect from the umbrella cover when installed. According to one aspect of the present invention, the umbrella rib and tip arrangement comprises an umbrella rib having a front end terminating in a plug rod, and a T-cap having an arched transverse head mounted in a pocket at the periphery of an umbrella cover and a circular longitudinal cap body perpendicularly extended from the arched transverse head and capped on the plug rod of the umbrella rib. According to another aspect of the present invention, the T-cap is reinforced with a rectangular bushing on the inside, and has a springy projecting strip projecting into an opening in the rectangular bushing which is forced into engagement with a transverse groove at the top of the plug rod of the umbrella rib to stop the umbrella rib from backward movement when the plug rod is inserted into the rectangular bushing. As an alternate form of the present invention, the umbrella rib and tip arrangement comprises an umbrella rib having a front end terminating in an arched transverse tip, the arched transverse tip being covered with a flexible cap and mounted within a pocket at the periphery of the umbrella cover.

DETAILED DESCRIPTION OF THE PREFERRED EMBODIMENT

Figure 1:
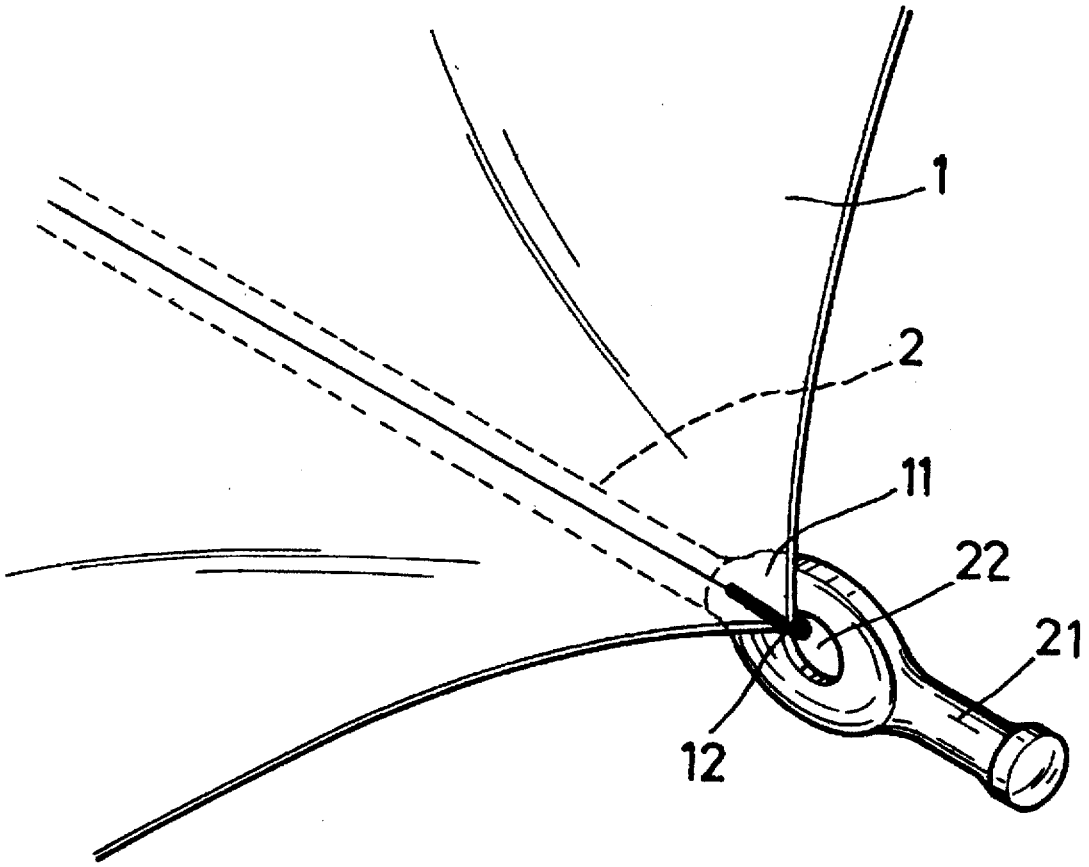
PRIOR ART FIG. 1
FIG. 1 shows an umbrella rib and tip arrangement according to the prior art.
Figure 2:
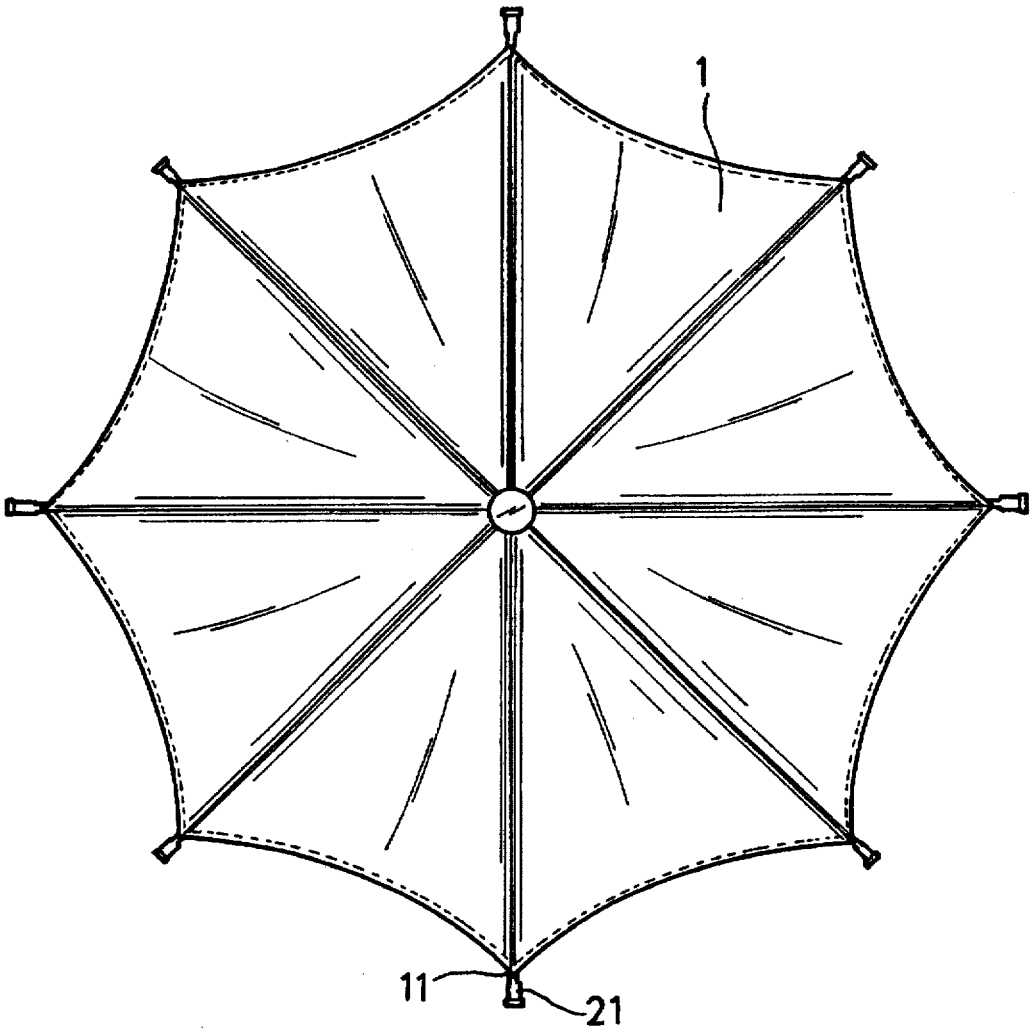
PRIOR ART FIG. 2
FIG. 2 shows the umbrella cover stretched, and the tip of the umbrella rib protruded over the periphery of the umbrella cover according to the prior art.
Figure 3:
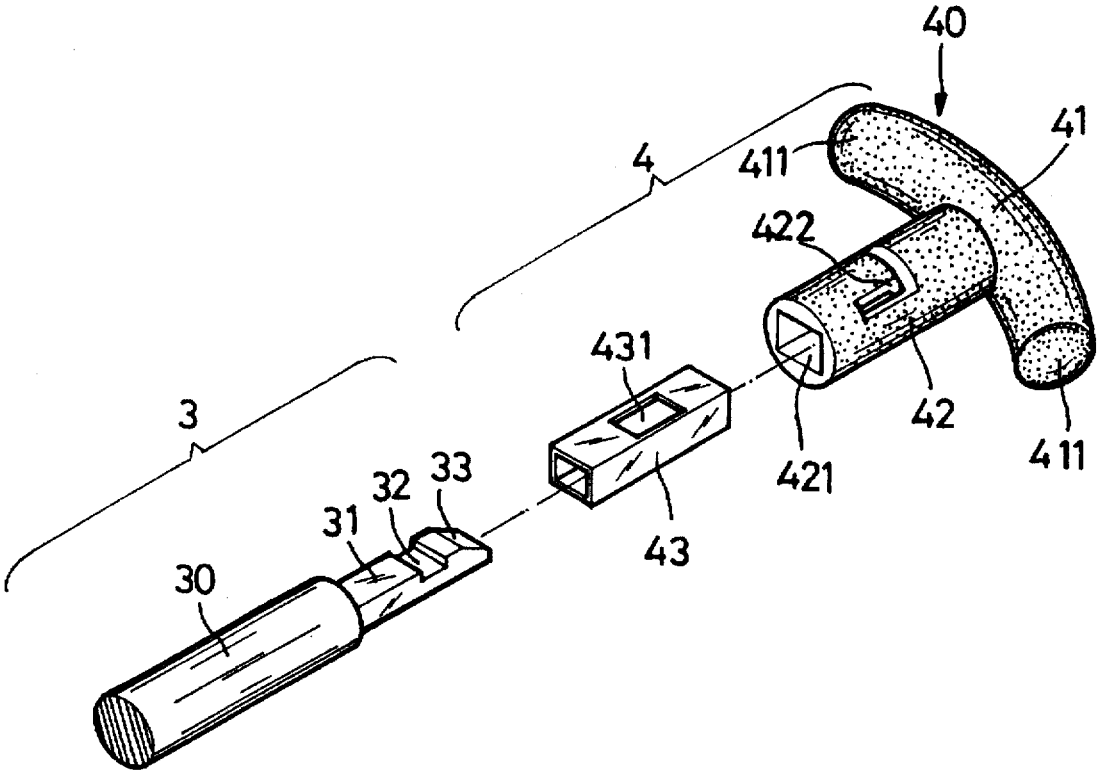
FIG. 3 is an exploded view of an umbrella rib and tip arrangement according to the present invention.
Figure 4:
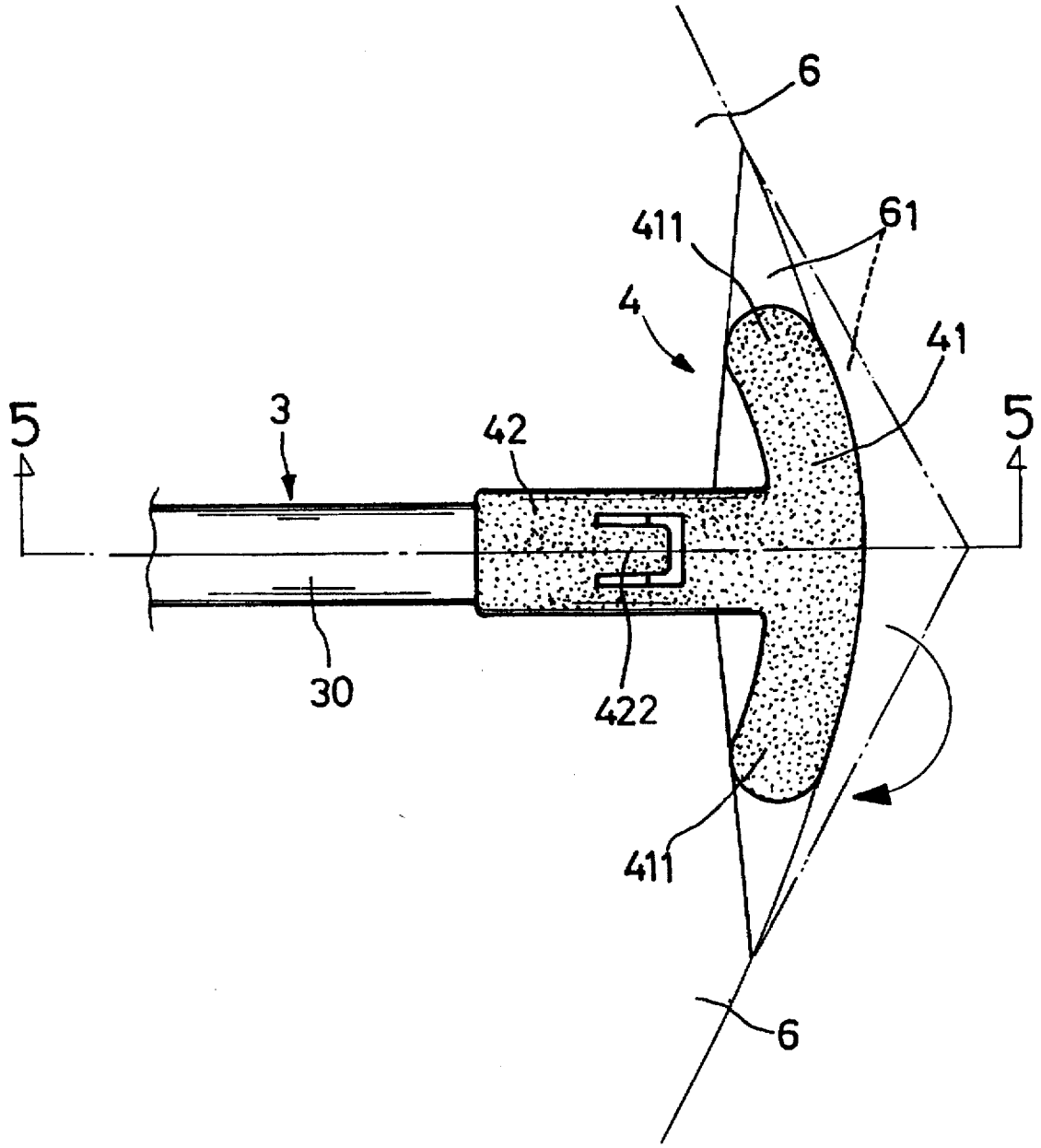
FIG. 4 is a top view of the present invention, showing the umbrella rib and the tip assembly connected together, and the T-cap of the tip assembly fastened to the pocket of the umbrella cover.

Referring to FIGS. 3 and 4, an umbrella rib and tip arrangement in accordance with the present invention comprises an umbrella rib 3 for stretching an umbrella cover 6, and a tip assembly 4 fastened to the end of the umbrella rib 3. The umbrella rib 3 comprises an elongated rib body 30 having a front end terminating in a rectangular plug rod 31. The plug rod 31 has a beveled front edge 33, and a transverse groove 32 at the top. The tip assembly 4 is comprised of a T-cap 40 injection-molded from flexible plastic material, and a rigid rectangular bushing 43. The T-cap 40 comprises an arched transverse head 41, and a circular longitudinal cap body 42 perpendicularly extended from the arched transverse head 41 in the middle. The circular longitudinal cap body 42 has a rectangular plug hole 421 axially disposed at one end adapted for receiving the rectangular bushing 43, and a springy projecting strip 422 axially extended from a part of the circular longitudinal cap body 42 into the rectangular plug hole 421 in direction toward the arched transverse head 41. The rectangular bushing 4 has a rectangular opening 431 corresponding to the transverse groove 32 of the rib body 30.

The rectangular bushing 4 is preferably made from rigid metal, and press-fit into the rectangular plug hole 421 of the circular longitudinal cap body 42. Alternatively, the T-cap 40 can be directly molded on the rectangular bushing 43. The rectangular bushing 4 may be eliminated if the T-cap 40 is injection-molded from rigid plastic material. The plug rod 31, the bushing 43, and the plug hole 421 are preferably made of rectangular shape, so that they are prohibited from rotary motion relative to one another when they are connected together. Alternatively, they can be made of any of a variety of polygonal shapes, such as triangular shape, pentagonal shape, etc.

Referring to FIG. 4, the arched transverse head 41 of the T-cap 40 is mounted within a pocket 61 at the periphery of the umbrella cover 6, and then the circular longitudinal cap body 42 is attached to the plug rod 31 of the rib body 30 of the umbrella rib 3.

Figure 5:
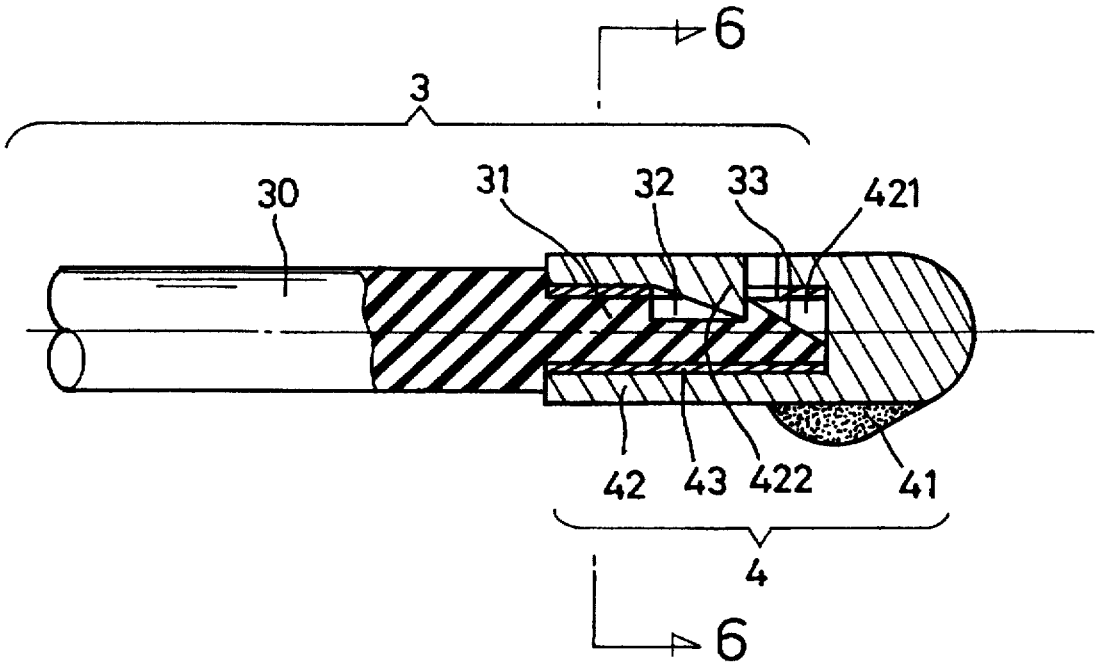
FIG. 5 is a sectional view taken along line 5—5 of FIG. 4.

Referring to FIG. 5, when the plug rod 31 of the rib body 30 of the umbrella rib 3 is inserted into the rectangular plug hole 421 of the circular longitudinal cap body 42 of the T-cap 40, the rectangular bushing 43 is sleeved onto the plug rod 31, and the springy projecting strip 422 will be forced upwards (radially outwards) by the beveled front edge 33 of the plug rod 31. When the beveled front edge 33 passes over the springy projecting strip 422, it immediately returns to its former shape and forced by its springy power into engagement with the transverse groove 32 of the plug rod 31 to stop the plug rod 31 from backward movement.

Figure 6:
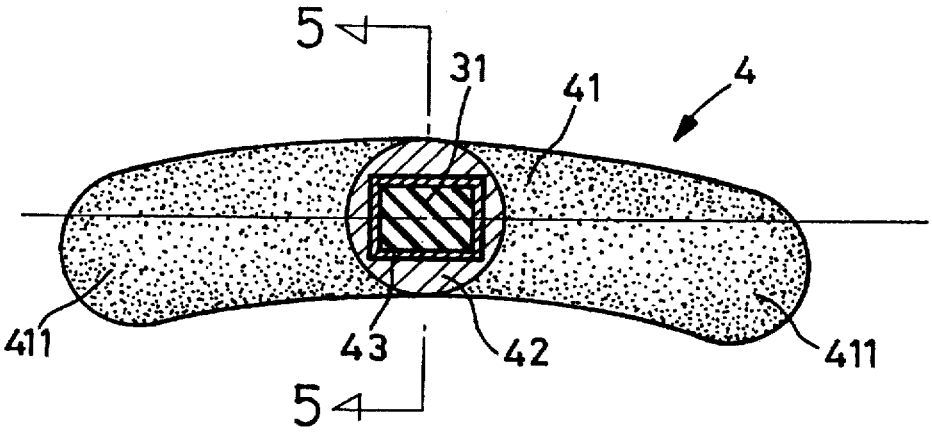
FIG. 6 is a sectional view taken along line 6—6 of FIG. 5.

FIG. 6 is a sectional view taken along line 6—6 of FIG. 5. The arched transverse head 41 of the T-cap 40 has two opposite ends 411 smoothly bilaterally curved inwards toward the circular longitudinal cap body 42.

Figure 7:
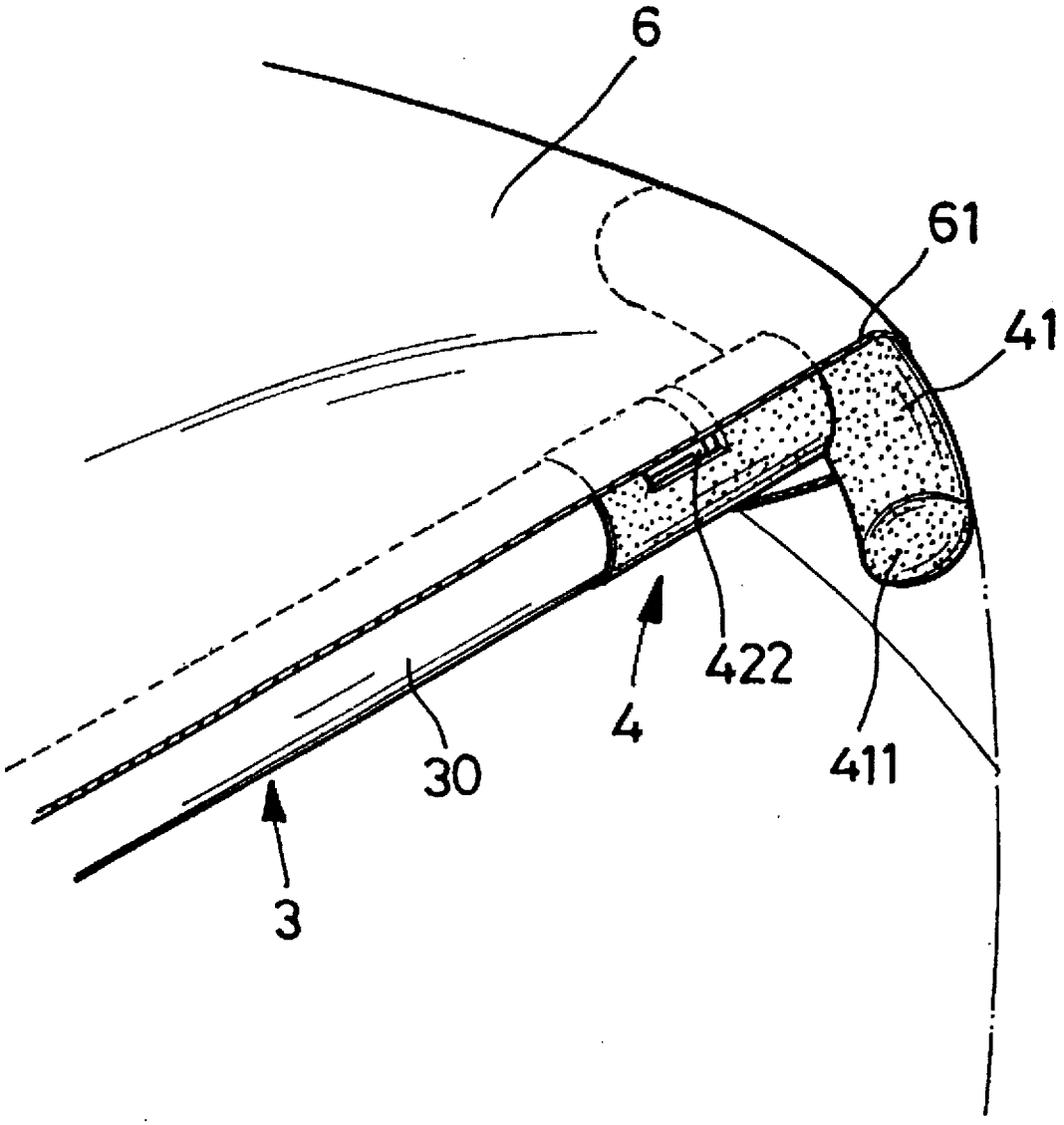
FIG. 7 is a cutaway view of the umbrella cover, showing the T-cap fastened to the pocket of the umbrella cover according to the present invention.
Figure 8:
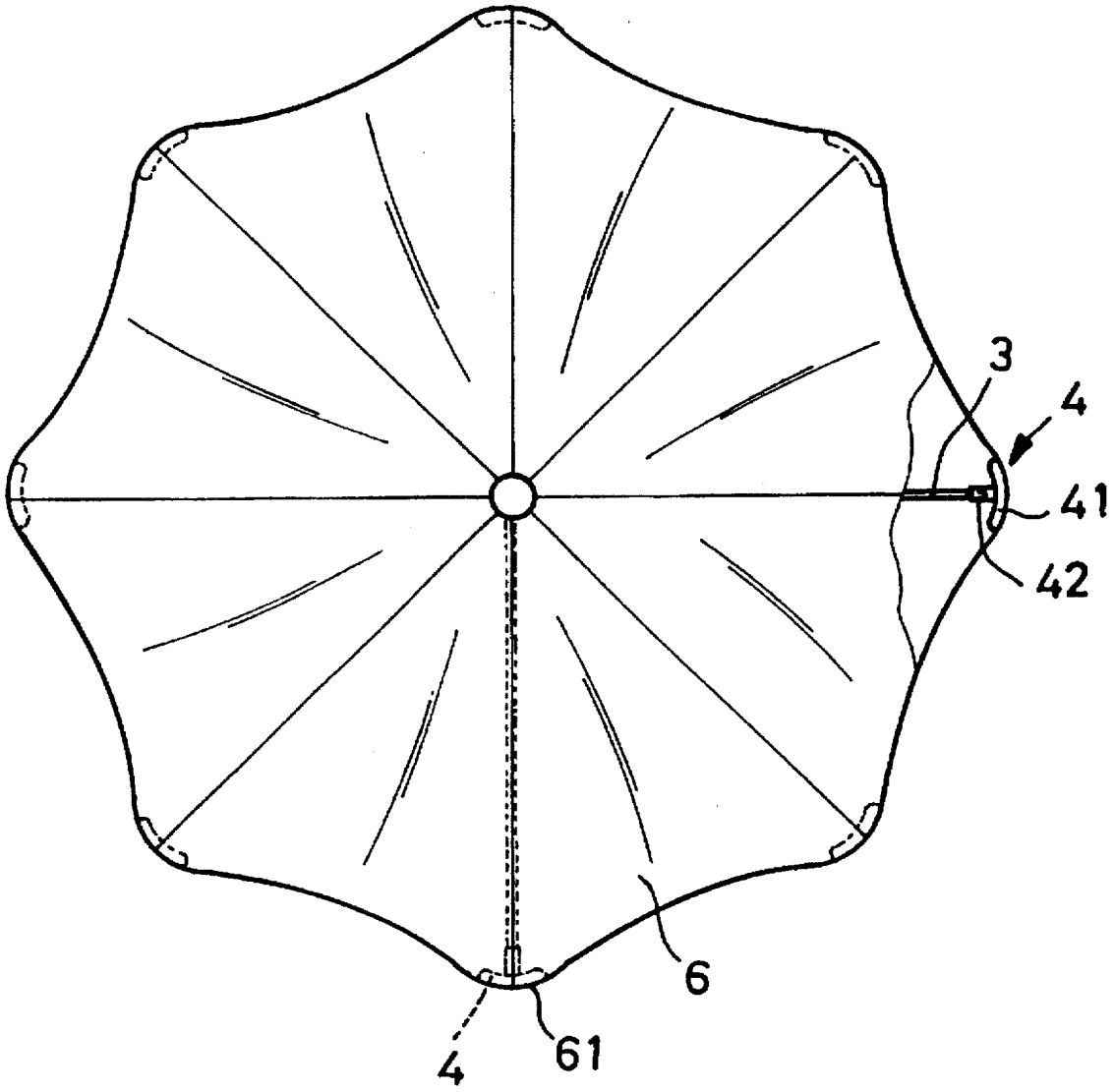
FIG. 8 shows the umbrella cover stretched according to the present invention.

Referring to FIGS. 7 and 8, and FIG. 4 again, the umbrella cover 6 is fastened to the arched transverse head 41 of the T-cap 40 by the pocket 61, and the connection between the tip assembly 4 and the umbrella rib 3 is secured by the springy projecting strip 422. Therefore, the umbrella rib 3, the tip assembly 4, and the umbrella cover 6 are firmly secured together. When the umbrella is opened, the umbrella cover 6 is stretched by the arched transverse head 41. Because the arched transverse head 41 is closely attached to the periphery of the umbrella cover 6, the tip assembly 4 does not hurt people.

Figure 9:
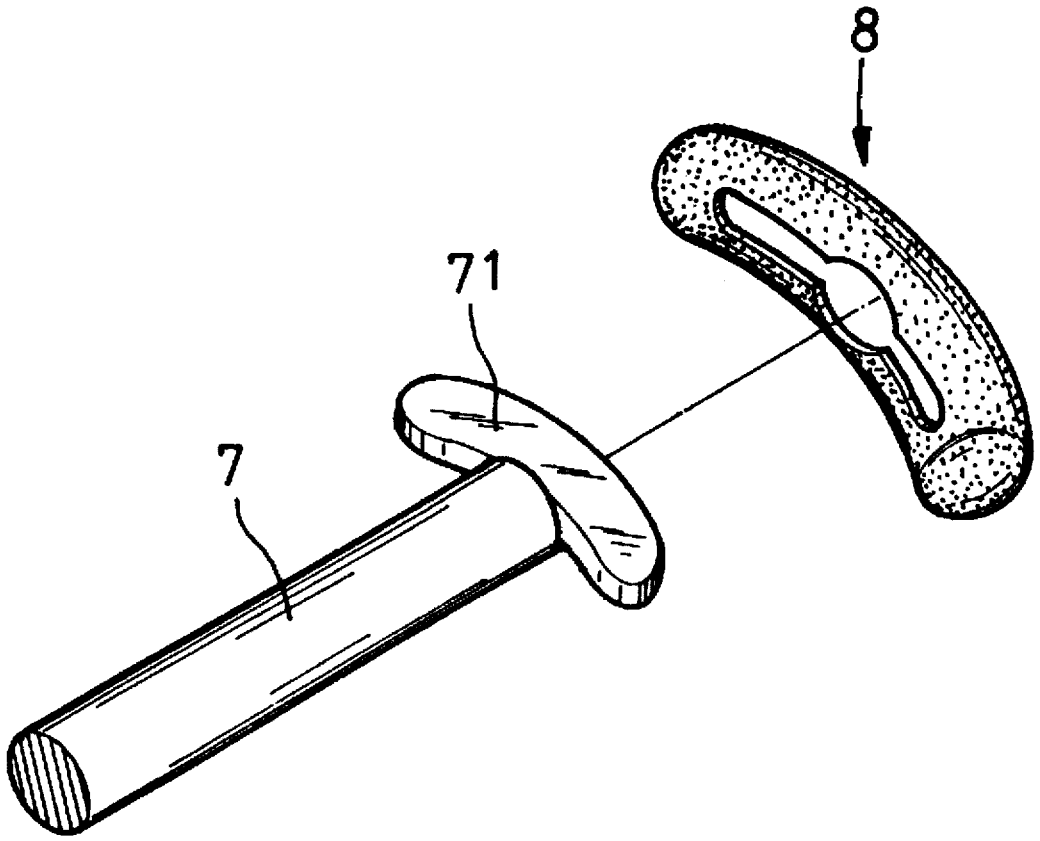
FIG. 9 is an exploded view of an alternate form of the present invention.
Figure 10:
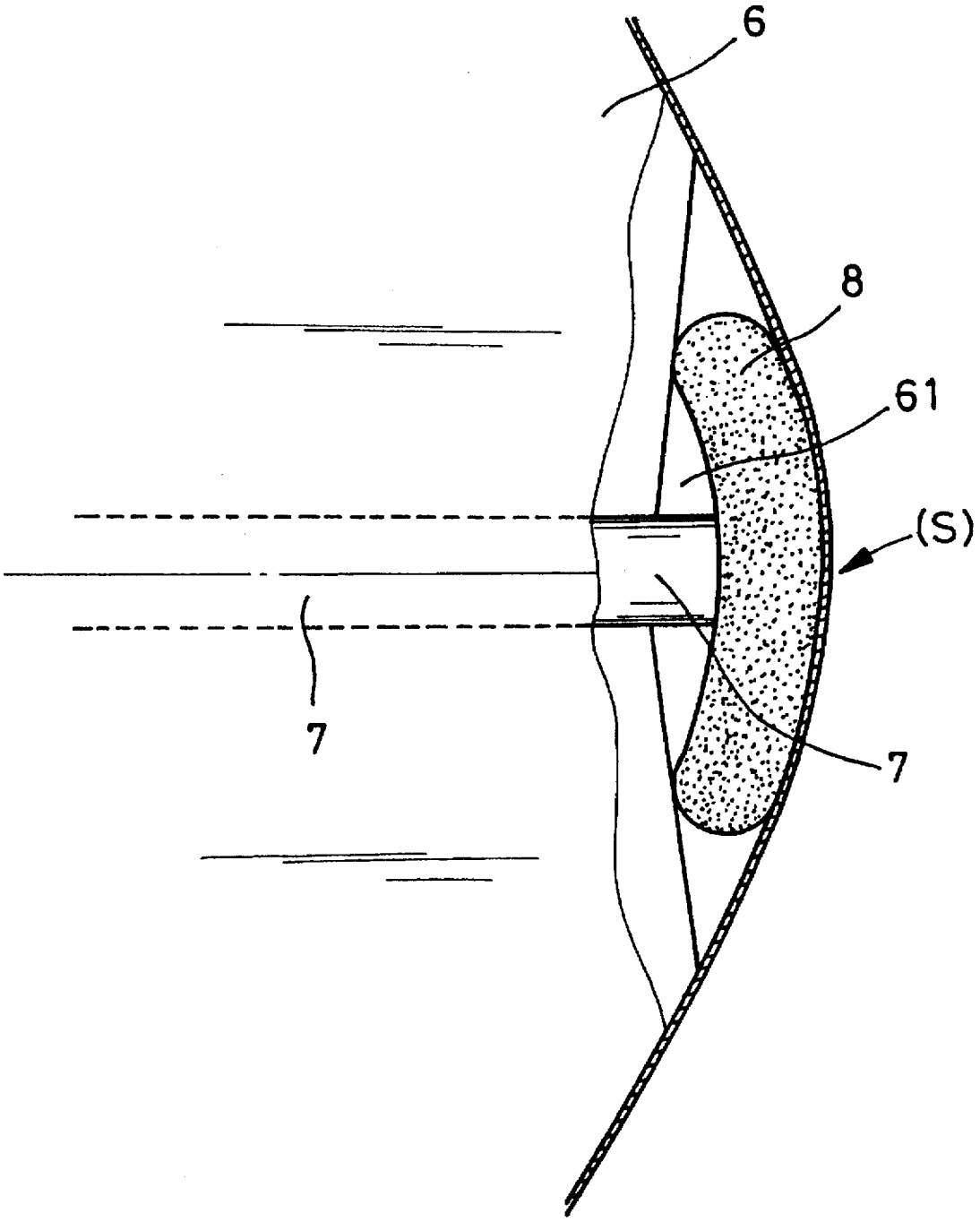
FIG. 10 is an installed view of the alternate form of the umbrella rib and tip arrangement of the present invention.

FIGS. 9 and 10 show an alternate form of the present invention, in which the umbrella rib 7 has an arched transverse tip 71, and a flexible cap 8 is covered on the arched transverse tip 71 of the umbrella rib 7. When the umbrella cover 6 is stretched, the border of the umbrella cover 6 forms a smoothly curved edge S. Because no projecting tips at the periphery of the umbrella cover and the umbrella is opened, the umbrella is safe in use.

It is to be understood that the drawings are designed for purpose of illustration only, and are not intended as a definition of the limits and scope of the invention disclosed.

What the invention claimed is:

1. An umbrella rib and tip arrangement for maintaining a smoothly curved configuration of an umbrella cover periphery having a plurality of pockets formed in the periphery thereof, comprising:

an umbrella rib having a front end terminating in a plug rod;

a T-cap mounted in a respective one of the pockets at the periphery of the umbrella cover and coupled to said plug rod, said T-cap being made from a flexible material and having an arched transverse head mounted in the pocket of the umbrella cover, said T-cap having a circular longitudinal cap body extending perpendicularly from said arched transverse head and having a rectangular plug hole formed therein; and, a rigid rectangular bushing disposed in said rectangular plug hole of said circular longitudinal cap body, said plug rod of said umbrella rib being press-fit into said rectangular bushing.

2. An umbrella rib and tip arrangement for maintaining a smoothly curved configuration of an umbrella cover periphery having a plurality of pockets formed in the periphery thereof, comprising:

an umbrella rib having a front end terminating in a plug rod, said plug rod having a beveled front edge and a transverse groove at a top side thereof behind said beveled front edge;

a T-cap mounted in a respective one of the pockets at the periphery of the umbrella cover and coupled to said plug rod, said T-cap having an arched transverse head mounted in the pocket of the umbrella cover and a circular longitudinal cap body extending perpendicularly from said arched transverse head, said circular longitudinal cap body having a rectangular plug hole formed therein and a springy projecting strip formed in said circular longitudinal cap body; and, a rigid rectangular bushing disposed in said rectangular plug hole of said circular longitudinal cap body for receiving said plug rod therein, said rectangular bushing having a rectangular opening formed therein, said plug rod of said umbrella rib being press-fit into said rectangular bushing with said springy protecting strip extending through said rectangular opening for engagement with said transverse groove of said plug rod of said umbrella rib to stop said umbrella rib in said rectangular bushing.

* * * * *